United States Patent [19]

Bowen

[11] 3,942,796

[45] Mar. 9, 1976

[54] FOOTBALL PRACTICE BLOCKING AND TACKLING REACTION MACHINE

[76] Inventor: Ronald S. Bowen, R.R. No. 1, Valley Center, Kans. 67147

[22] Filed: Oct. 15, 1973

[21] Appl. No.: 406,256

[52] U.S. Cl. ..... 273/55 R

[51] Int. Cl.[2] ..... A63B 69/00

[58] Field of Search ..... 273/55 R, 55 A; 272/79 R

[56] References Cited

UNITED STATES PATENTS

| | | | |
|---|---|---|---|
| 2,162,073 | 6/1939 | Evans | 273/55 R |
| 2,234,364 | 3/1941 | Carberry | 273/55 R |
| 3,458,192 | 7/1969 | Trice, Jr. | 273/55 R |

*Primary Examiner*—Jerome Schnall
*Assistant Examiner*—T. Brown
*Attorney, Agent, or Firm*—John H. Widdowson

[57] ABSTRACT

A reaction machine for football practice or the like. An upright is provided supported from its lower portion by a base. A beam is pivotally mounted with the upright pivotable horizontally around the upright and pivotable vertically. A dummy support arm is vertically pivotally mounted on one end of the beam for mounting a tackle dummy or the like. A brake assembly is mounted between the beam and upright for holding the beam in a fixed horizontal position. A shock absorber is also mounted between the upright and beam for absorbing the shock of a player hitting the dummy. The dummy support arm and beam are provided with latch structure for holding the dummy in a raised position and releasing the dummy to a lowered position.

5 Claims, 13 Drawing Figures

FOOTBALL PRACTICE BLOCKING AND TACKLING REACTION MACHINE

BACKGROUND OF THE INVENTION

The invention relates to football practice devices and more particularly to a dummy support apparatus for use by football players and the like for practicing tackling, charging, blocking and other physical contact maneuvers. Numerous types of tackling dummy apparatuses are known in the prior art as they are now and have been commonly used for training football players in the history of the sport. Football practice dummies are of the two general types: one type has the padded dummy mounted on a sled or the like and the other type has the practice dummy suspended. The suspended type practice dummies are known in the prior art which have dummies supported above the ground on a pivotal apparatus which holds the dummy in a fixed position and will allow the dummy to be moved around its support to another position after it has been struck by the player. Other prior art practice dummy apparatuses are known which support the dummy in an upright position above the ground so the dummy can be pivoted or moved relative to a fixed pivoted point in a partially circular range of motion at the will of the coach. In some instances dummies have been suspended from an overhead track or beam and they swing about freely like a weight suspended on a string. In some instances, dummies have been supported from an overhead track or beam with the dummies being rotatable about their upright axis.

However, it is not known that any practice dummy apparatus herebefore produced has provided a practice dummy which can be moved at the ground level at the will of the coach and raised to an elevated position upon contact by the player.

SUMMARY OF THE INVENTION

In the specific embodiments of this invention a reaction machine structure includes an upright with a beam pivotally mounted on the upper portion of the upright to rotate in a horizontal direction and to be pivotable in a vertical direction and having a vertically swingably mounted dummy support arm on one end of the beam for mounting a tackling dummy or the like. The dummy support arm is movable between a lowered position placing the dummy at ground level and a raised position with the dummy above ground level. The beam is rotatable and the horizontal direction to move the position of the dummy at the will of the coach or the person operating the machine. The dummy support arm can be fixed in the raised position relative to the beam and since the beam can be pivoted in the vertical direction the dummy can be placed at the ground level for player contact or supported in a position above ground level for player contact if desired. The dummy can be positioned on the ground with the dummy support arm in the lowered position and moved to the raised position when the dummy is struck by a player.

One object of this invention is to provide a reaction machine structure overcoming the aforementioned disadvantages of the prior art devices.

Still, one other object of this invention is to provide a reaction machine structure having an upright supported by a base with a beam pivotally mounted with the upper end of the upright with the beam being pivotable in a horizontal direction completely around the upright and pivotal in a vertical direction and further with the beam having a swingably mounted dummy support arm on one end thereof for mounting a tackling dummy or the like with the swingable support arm movable between a lowered position and a raised position relative to the beam and retainable in the raised position if desired.

Still, one other object of this invention is to provide a reaction machine structure having a dummy support arm for mounting a tackling dummy or the like which will allow the dummy to be moved vertically and rotated horizontally about the upright support of the machine and further with the tackling dummy movable between a lowered position at ground level and a raised position above ground level.

Yet, another object of this invention is to provide a reaction machine structure for football practice which has a dummy movable in a vertical direction and a shock absorber apparatus to retard excessively rapid vertical movement of the supporting structure for the tackling dummy.

Various other objects, advantages, and features of the invention will become apparent to those skilled in the art from the following discussion, taken in conjunction with the accompanying drawings.

Figure 1:
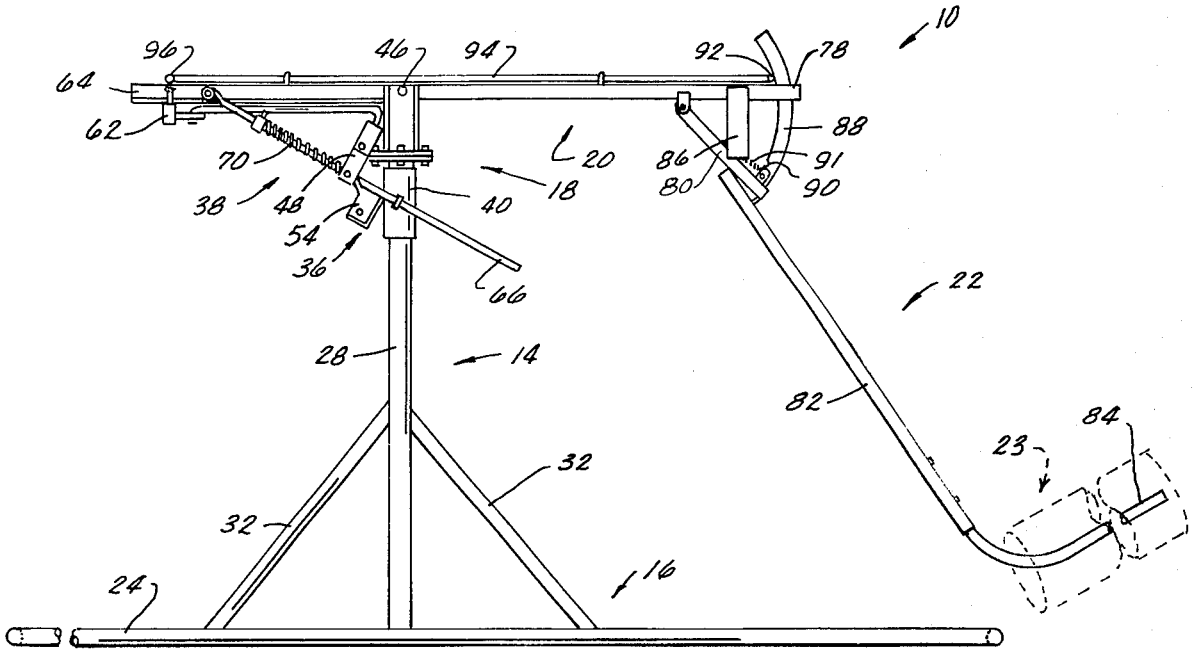
FIG. 1 is a side elevation view of an embodiment of reaction machine with the dummy support arm in a lowered position having the tackling dummy indicated in dashed lines, and the base and the dummy support arm shortened for clarity.

The following is a discussion and description of the preferred specific embodiments of the reaction machine structure of this invention, such being made with reference to the drawings, whereupon the same reference numerals are used to indicate the same or similar parts and/or structure. It is to be understood that such discussion and description is not to unduly limit the scope of the invention. wavelengths

DESCRIPTION OF PREFERRED EMBODIMENTS

The reaction machine of this invention is disclosed herein in two specific embodiments thereof. An embodiment, (1), of the reaction machine of this invention is shown in the drawings in FIGS. 1–7 thereof and such is generally indicated at 10. Another embodiment, (2), of the reaction machine of this invention is shown in the drawings in FIGS. 8–13 thereof and generally indicated at 12.

Figure 2:
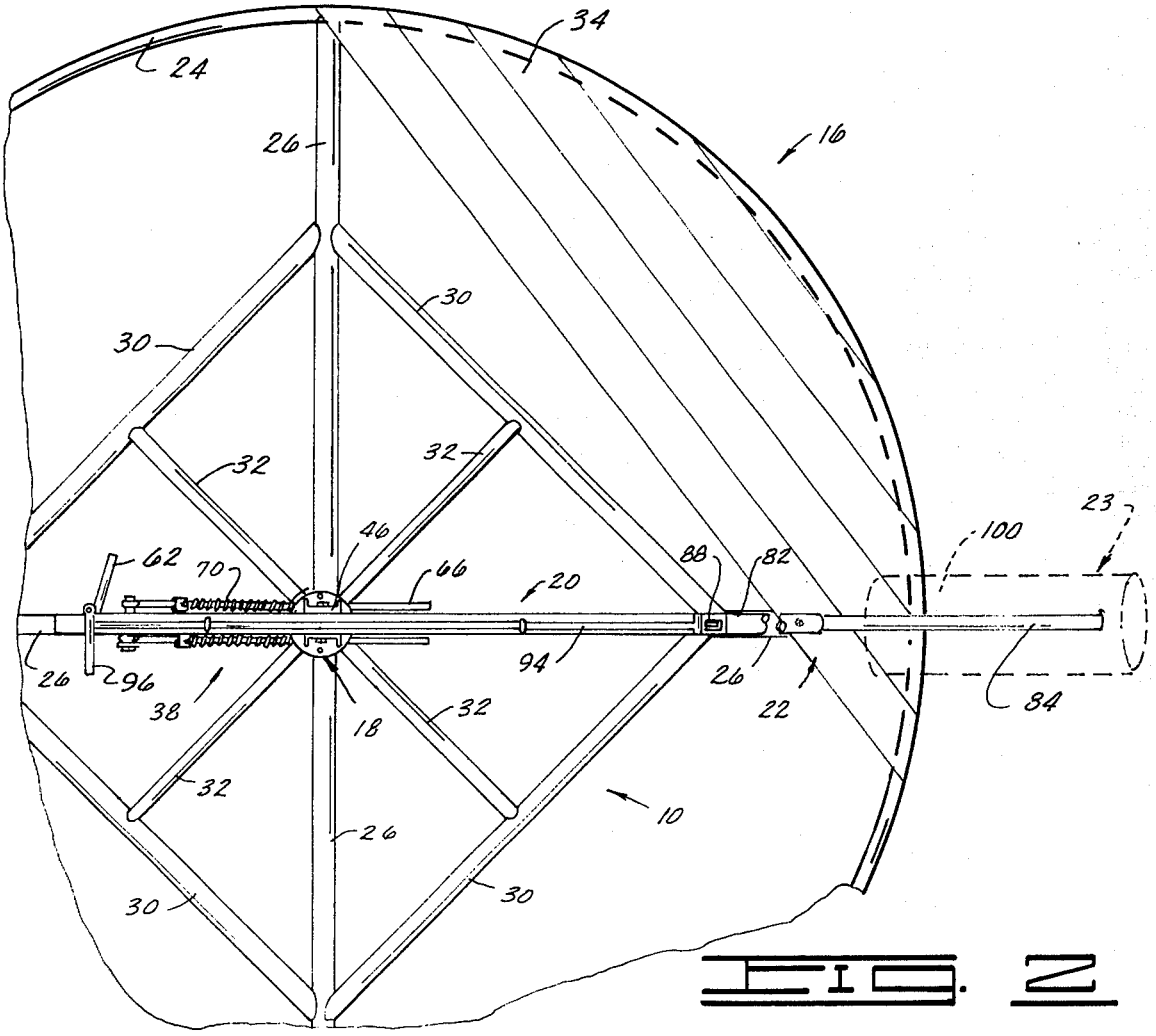
FIG. 2 is a top plan view of the reaction machine shown in FIG. 1 showing a portion of the base thereof with a portion of the platform cover of the base removed for clarity.

Referring to the drawings in detail and in particular to Sheets 1, 2 and 3, such depicts the first described embodiment, (1), of the reaction machine of this invention. The reaction machine 10 includes an upright 14 supported on its lower end by a base 16 having a hub 18 pivotally mounted on the upper end of the upright 14, a beam 20 is pivotally mounted with the hub 18 to pivot in a generally vertical direction, and a dummy support arm 22 swingably mounted with one end portion of the beam 20. A tackling dummy or the like is mounted on the end of the dummy support arm 22 as shown and generally indicated at 23. The base 16 provides structural support for the upright 14 to hold it in a generally vertical position as shown. The base 16 is preferably constructed as shown in FIGS. 1 and 2 so the reaction machine 10 can be moved about on a football practice field or other supporting surface where the reaction machine 10 is to be used. The base 16 has an outer generally annular member 24 connected by cross members 26 joined in the center portion of the base with the upright 14 extending vertically upward from the juncture of the cross members 26. The upright 14 has a standard indicated at 28 such as a pipe. In the horizontal portion of the base 16 alternate cross members 30 join mid-points of the cross members 26 for bracing of the base structure. Upwardly extending braces 32 are secured to the upright standard 28 and the alternate cross members 30 for structural support of the upright 14 as shown. Preferably, the base 16 is constructed in a generally circular shape from pipes, tubing or like members that are joined by welding. The upper surface of the base 16 is preferably constructed as a platform covered by planks 34 or the like so a person may walk around the base standing thereon while operating the reaction machine. As the reaction machine base 16 sets flush with the ground or other supporting surfaces, the reaction machine can be easily pulled or pushed to a desired location for use for storage. It is to be noted that the base 16 can be constructed different from the base structure shown in the drawings, for example it can be permanently mounted in the ground or constructed to be mounted with a socket in the ground and removable therefrom.

Figure 3:
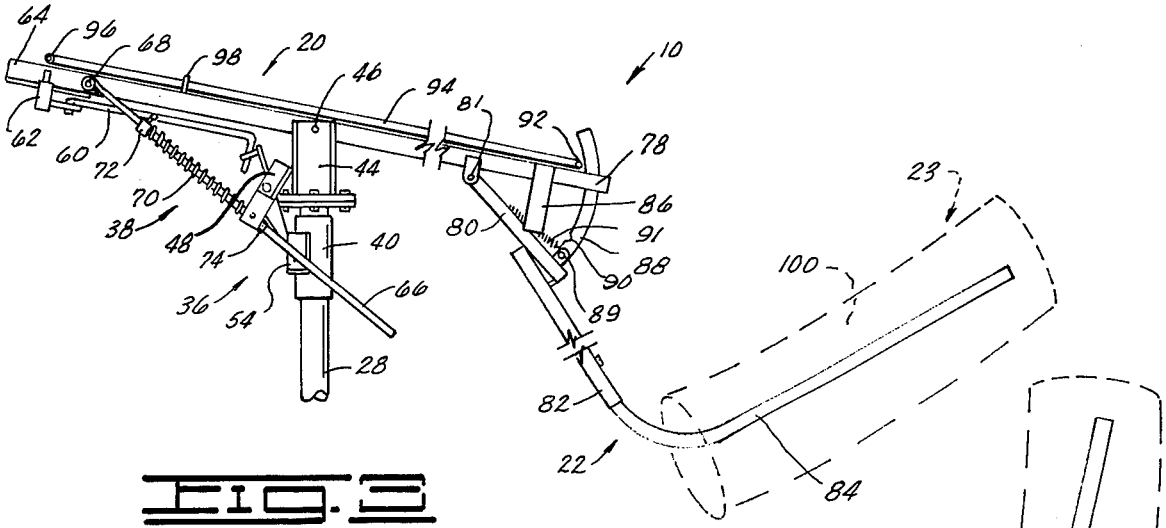
FIG. 3 is a side elevation view of the upper portion of the reaction machine shown in FIG. 1, the machine being positioned ready for use with the dummy support arm in a lowered position, and the brake set, with the dummy support arm shortened for clarity.
Figure 5:
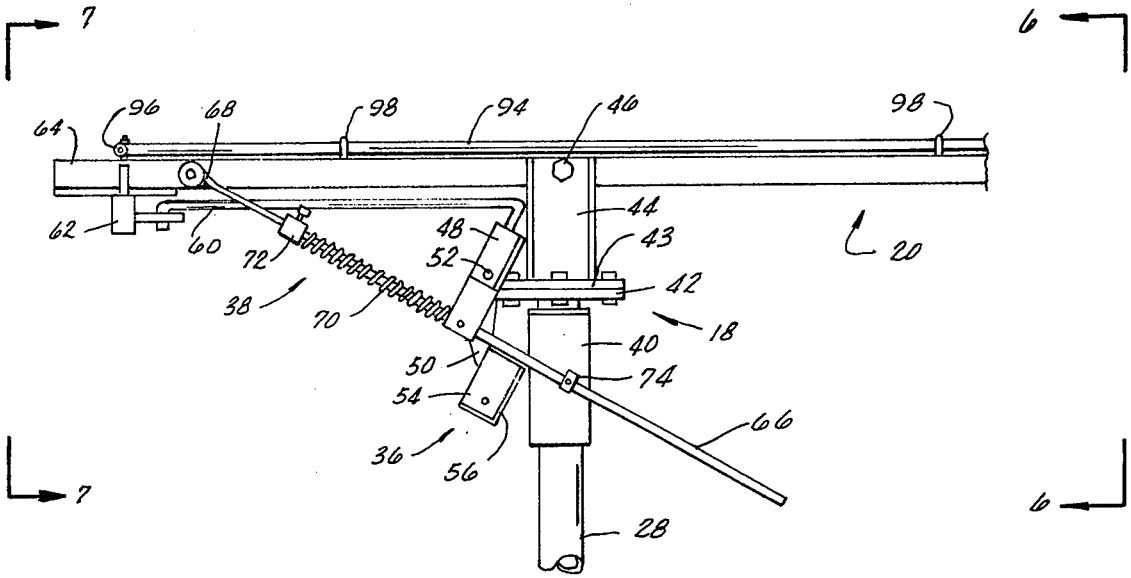
FIG. 5 is an enlarged side elevation view of the center portion of the upper portion of the reaction machine shown in FIG. 1 with the beam in a horizontal position and the brake in a released position.
Figure 6:
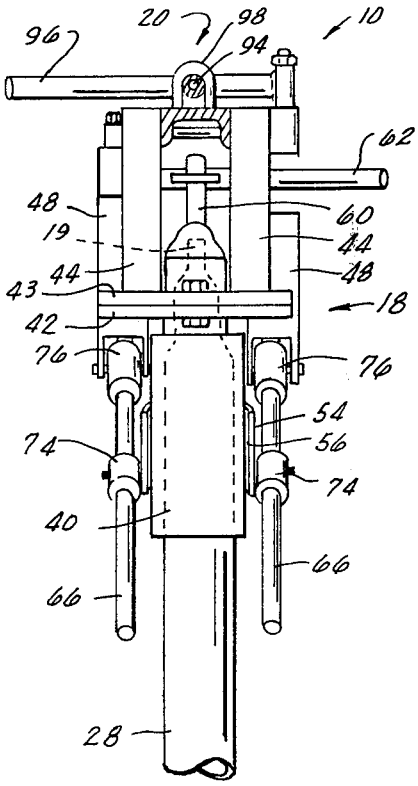
FIG. 6 is an elevation view of the upper portion of the reaction machine shown in FIG. 1, the view taken on line 6—6 of FIG. 5.

The hub 18 is rotatably mounted with the upper end of the upright 14 on a spindle portion thereof and the beam 20 is mounted at a mid portion thereof with the hub so it can be rotated horizontally in a full circle around the upright. The spindle portion of the upright 14 is shown in dashed lines in FIG. 6 and indicated at 19. A brake assembly, generally indicated at 36, is mounted with the hub 18. A shock absorber assembly, indicated generally at 38, is connected between the beam 20 and the hub 18 as shown to retard excessively rapid vertical pivoting movement of the beam 20 when the dummy support arm 22 is raised rapidly. FIG. 5 shows an enlarged view of the upper portion of the reaction machine in the center portion thereof. The upright standard 28 has a collar 40 rigidly secured thereto, preferably by welding, on the upper end portion thereof immediately below the hub 18. The spindle 19 extends upward from the upper end of the upright standard 28 for rotatably mounting the hub 18. The hub 18 has a flange 42 extending from the portion of the hub which is mounted with the spindle 19. A second flange 43 is secured with the flange 42 and has a pair of upright and spaced members 44 extending upward therefrom for mounting the beam 20. The upright spaced members 44 are on opposite sides of the center portion of the hub 18 as shown in FIG. 6. The beam 20 is supported on a shaft the end of which is indicated at 46. Preferably the beam supporting shaft is positioned generally in line with the axis of rotation of the hub 18. A combination guide member for the shock absorber assembly and brake assembly support is secured with the hub 18 to provide support for the brake assembly 36 and to provide a guide for a portion of the shock absorber assembly 38. The combination guide support member is indicated at 48 and includes a pair of like members constructed in a mirror image fashion which are secured with the upper hub flange 43 and the hub upright members 44 in an angular position as shown. The brake assembly 36 has a pivotally mounted brake shoe support member 50 pivotally mounted by a shaft 52 connected between the combination support members 48 as shown in detail in FIG. 7. A brake shoe 54 is secured to the lower end of the brake shoe support member 50 and has a friction pad 56 on the interior thereof as indicated in FIGS. 5 and 6. The brake shoe 54 is curved to fit around a portion of the collar 40 on the upright standard 28. The upper end of the brake shoe support member 50 has a ring like member 58 connected with a brake rod 60 which is in turn and connected with a brake control lever 62 pivotally mounted on the operator end portion 64 of the beam 20. The brake rod 60 is curved as shown on the end portions to attach the brake shoe support member 50 and the brake control lever 62. Pulling the brake control lever 62 rearward or rotating it so as to move the brake rod 60 outward relative to the hub 18 causes the brake shoe support 50 to rotate about the shaft 52 and brings the brake shoe 54 in contact with the collar 40. FIG. 3 shows the brake assembly 36 in the engaged position with the brake shoe 54 in contact with the collar 40. Normally the brake is applied once the tackling dummy or the like 23 is dropped or placed for a player to hit in order to keep the beam 20 in a fixed horizontal position relative to the upright 14.

Figure 7:
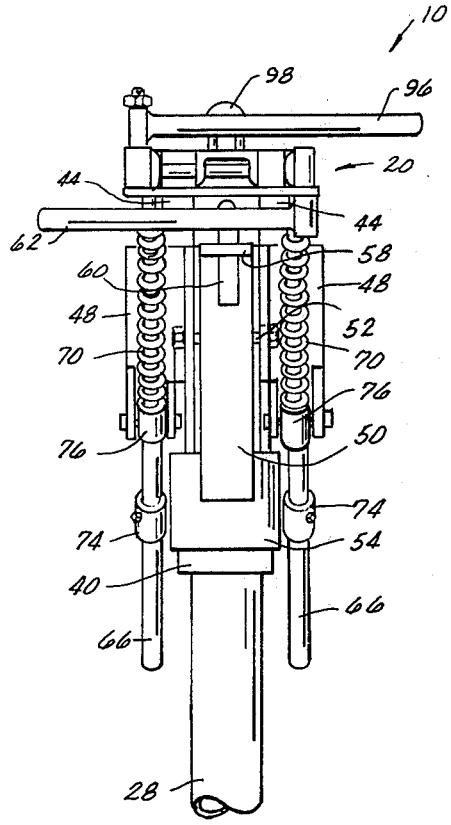
FIG. 7 is an elevation view of the operator end of the reaction machine shown in FIG. 1, the view taken on line 7—7 in FIG. 5.

The shock absorber assembly 38 is connected between the operator end portion 64 of the beam 20 and the combination guide support members 48 attached to the hub 18 and it functions to retard excessively rapid vertical pivoting motion of the beam 20 when the operator end portion 64 is lowered. The shock absorber assembly 38 includes a pair of guide rods 66 attached at the upper end portion thereof 68 by pivotal mounts with the beam 20, helical springs 70 on the guide rods 66, as shown, stop members 72 on the upper end portions of the guide rods 66, lower stop members 74 on the lower end portion of the guide rods 66 and guide rod support members 76 mounted with the combination support members 48. A spring, a guide rod, etc., is preferably provided on opposite sides of the beam 20 and hub 18 as shown to prevent undue twisting of the structure. The guide rod support members 76 are pivotally mounted with the combination support members 48 and are constructed to let the guide rods 66 slide therethrough when the beam 20 is pivoted in the vertical direction at its support with the hub 18. The support members 76 are preferably collar-like members as shown in FIGS. 6 and 7 which pivot on an axis transverse to the axis of the guide rods 66 with the guide rod support members 76 mounted in the notch-like portion of the combination support members 48. Positioning of the stops 72 and 74 limit the range of vertical pivotal motion of the beam 20. When the beams operator end 64 is raised the dummy support arm 22 is lowered and the stops 74 contact the guide rod support members 76 limiting the upward movement of that end of the beam. The stops 72 and 74 are preferably adjustably securable with the guide rods 66 so the limits of pivotal movement for the beam 20 can be adjusted as desired. When the beams operator end 64 is lowered, the spring 70 is compressed between the guide rod support members 76 and the upper stop members 72. Adjusting the position of the upper stop members 72 on the guide rods 76 can vary the amount of compression in the springs 70 and thus limit the downward movement of the beams operator end 64. Adjusting the compression in the springs 70 provides a control over the rate at which the beams operator end 64 can be lowered thus providing a control of its vertical pivoting speed. Controlling the downward movement of the beams operator end 64, by the shock absorber assembly 38 has two advantages: one, it lessens shock of impact forces on the machine which could damage it and; two, it makes the machine safer for a person to operate. In practice with the reaction machine 10 it has been found that the operator end of the beam 20 can be moved very rapidly downward when the tackling dummy 23 is raised rapidly from a ground level position to a raised position.

Figure 4:
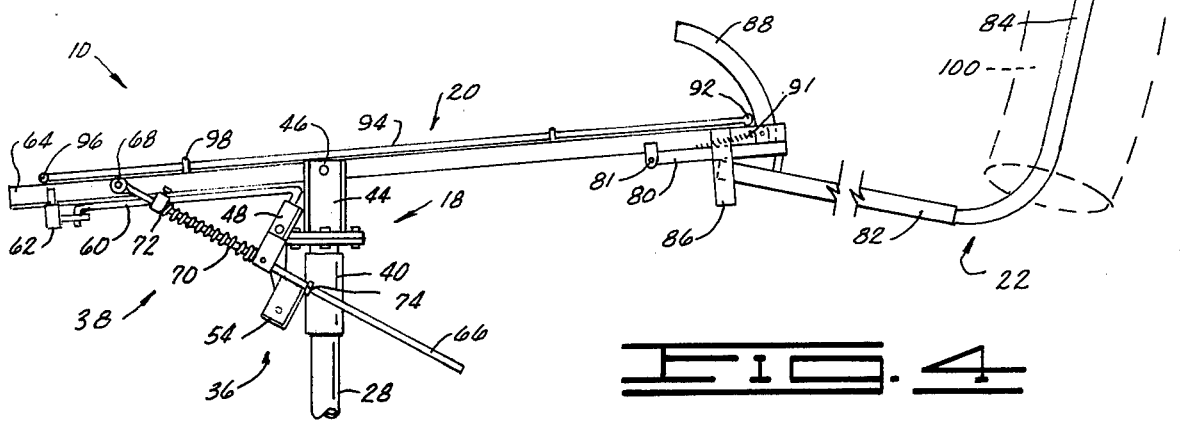
FIG. 4 is a side elevation view of the upper portion of the reaction machine shown in FIG. 1 with the dummy support arm in the raised position and the brake released, with the dummy support arm shortened for clarity.

FIG. 3 shows the reaction machine 10 with the beam 20 having the operator end thereof 64 raised, the dummy support arm 22 lowered and the brake assembly 36 set; this being the position the machine assumes when in use with the tackling dummy 23 in a ground contact position ready for a player to hit the dummy. FIG. 4 shows the reaction machine 10 with the beams operator end 64 lowered, the dummy support arm 22 in the raised position and the brake assembly 36 released; which is the position the machine would normally assume once the dummy 23 has been hit by a player and raised. As a player hits the dummy 23 the dummy support arm 22 is raised rapidly thus causing the beams operator end portion 64 to be lowered in a rapid fashion once it reaches the raised position relative to the beam 20. Forces tending to cause the beams operator end portion 160 to be lowered are impact forces of the dummy support arm contacting or hitting the beam 20 when the dummy support arm 22 reaches its limit of upper pivotal motion relation to the beam 20. The springs 70 of the shock absorber assembly 38 retard the rapid vertical movement of the beam and its pivoting motion. The springs 70 absorb some of the energy of the players impact which causes the beam 20 to be pivoted. It is to be noted that the springs 70 in the shock absorber assembly 38 can be replaced by other resilient members, for example rubber or rubber like resilient members or fluid containing resilient energy absorbing members.

The dummy support arm 22 is pivotally mounted with the beams player end portion, indicated at 78. The dummy support arm 22 has an upper arm portion 80 pivotally or swingably supported by a mount 81 with the lower side of the beam 20, a lower arm portion 82 rigidly connected with the upper arm portion 80, and a flexible arm portion 84 secured with the outer end of the lower arm portion 82 and turned upward therefrom as shown. The mount 81 for the upper arm portion 80 pivots the upper arm 80 on a shaft or on an axis transverse to the beam 20 so the upward arm portion 80 will move in line with the beam 20. A pair of guide members 86 are secured to the beams player end portion 78 and extend downwardly therefrom as shown on opposite sides of the beam 20 forming a guide for the upper arm portion 80. The guides 86 are positioned in a spaced relation so the upper arm portion 80 will move therebetween. the guides 86 prevent lateral bending or twisting movement of the upper arm portion 80 relative to the beam 20 which can be caused by shock forces imposed laterally on the dummy support arm 22.

The connection between the beam 20 and the dummy support arm 22 is provided with a latch to hold the dummy support arm 22 in a raised position. The latch apparatus includes a curved latch member pivotally mounted with and extending upwardly from the outer end portion of the upper arm portion 80 as shown in FIGS. 1, 3 and 4. The curved latch member 88 is supported on its lower end at a pivot 89. The curved latch member 88 is curved in the arc of a circle about the upper arm pivot 81, as shown, and it extends through a slot in the beam 20. The slot in the beam 20 is not visible in the drawings. A notch 90 is provided in what is the lower end portion of the curved latch member 88 the notch being engagable in an edge portion of the slot in the beam. A spring 91 is connected between the mounted end portion of the upper arm portion 80 and the lower portion or pivoted end portion of the curved latch member 88, as shown, to resiliently urge the curved latch member in the direction of the center portion of the beam for pulling the notch 90 into engagement with an edge of the slot in the beam 20. When the dummy support arm 22 is raised to the position shown in FIG. 4 the notch 90 is pulled over the edge of the slot in the beam 20 and retained in that position until released. Weight of the dummy support arm 22 holds the notch 90 in the latch member 88 being in contact with and in position on the beam 20 until released. So long as the curved latch member 88 is in the position shown in FIG. 4 the dummy support arm 22 will be retained in the raised position relative to the beam 20. A movable wedge member or block member 92 is provided which is movable on the beam 20 to move the curved latch member 88 and disengage the notch 90 from the edge portion of the slot in the beam for releasing the dummy support arm 22 from the raised position. The movable wedge or block 92 if preferably positioned as shown on the upper portion of the beam 20. The wedge or block 92 is connected to a control rod 94 joining it with the beams operator end portion where the control rod 94 is pivotally connected with a control lever 96. The wedge or block control lever 96 is preferably pivotally attached to the beams so moving the lever will move the wedge 92 along the beam. In order to release the dummy support arm 22 the control lever 96 is pushed in the direction of the beams player end portion 78 which pushes the block or wedge 92 into contact with the curved latch member 88 which in turn pushes the notch 90 from its engaged position with the edge of the slot and the beam. Once the notch is free from the beam the dummy support arm will drop due to the force of gravity.

The upturned flexible arm portion 84 of the dummy support arm 22 is preferably a leaf spring like member for mounting the tackling dummy 23. An elongated generally cylindrical tackling dummy is indicated specifically at 100 and shown in dashed lines in FIGS. 104. In general the tackling dummy may be any of numerous shapes, it is preferably a well padded generally annular object in an elongated form covering the flexible arm portion 84. Preferably, the tackling dummy 23 extends upward approximately to the waist of the player so that when the tackling dummy is in the lowered position it can be used for both blocking and tackling practice.

In the use and operation of the reaction machine 10 of this embodiment, (1), of this invention, such provides a machine particularly well adapted for use in training football players. The preferred use of the reaction machine 10 is to place it on a football practice field with the dummy support arm 22 in the raised position generally as illustrated in FIG. 3. At this time football players can rush the dummy 23 and as the coach or operator moves it horizontally in pivoting motion about the upright the player mirrors or follows movement of the dummy. At any given time the coach or operator can drop the dummy 23 and proper reaction by the player results in the dummy 23 being hit by the player before it reaches the ground driven or raised back to the raised position relative to the beam 20. The dummy 23 can be hit with the head, shoulders, or arms in offensive or defensive drills. The dummy support arm is dropped by pushing the wedge control lever 96. The brake assembly 36 should be engaged as shown in FIG. 3 when the dummy is dropped and prior to the player's contacting the tackling dummy 23 to insure that the beam 20 stays in a fixed horizontal position. If the player rushes the tackling dummy 23 from a position not directly in line with the beam 20 then the beam will be rotated about its rotatable attachment with the upright 14. Once the dummy support arm is raised the brake assembly 36 can be released. It is to be noted that the rotatable motion of the beam 20 in the horizontal direction allows two or more groups of football players to use the reaction machine 10 at the same time as they can be positioned on opposite sides rotary reaction machine and rush the tackling dummy in rapid succession alternately as it is positioned first in the direction of one group and the next in the direction of another group. Additionally, it is to be noted that the reaction machine can be used by putting the tackling dummy 23 in a lowered position at or near ground level so a player can rush it, hitting it and raising it to the raised position. As a person operates the reaction machine 10 he can walk around the upright 14 while standing on the base 116 and his weight in addition to the weight of the structure of the reaction machine 10 will retain same in position on the football practice field or other supporting surface.

Figure 8:
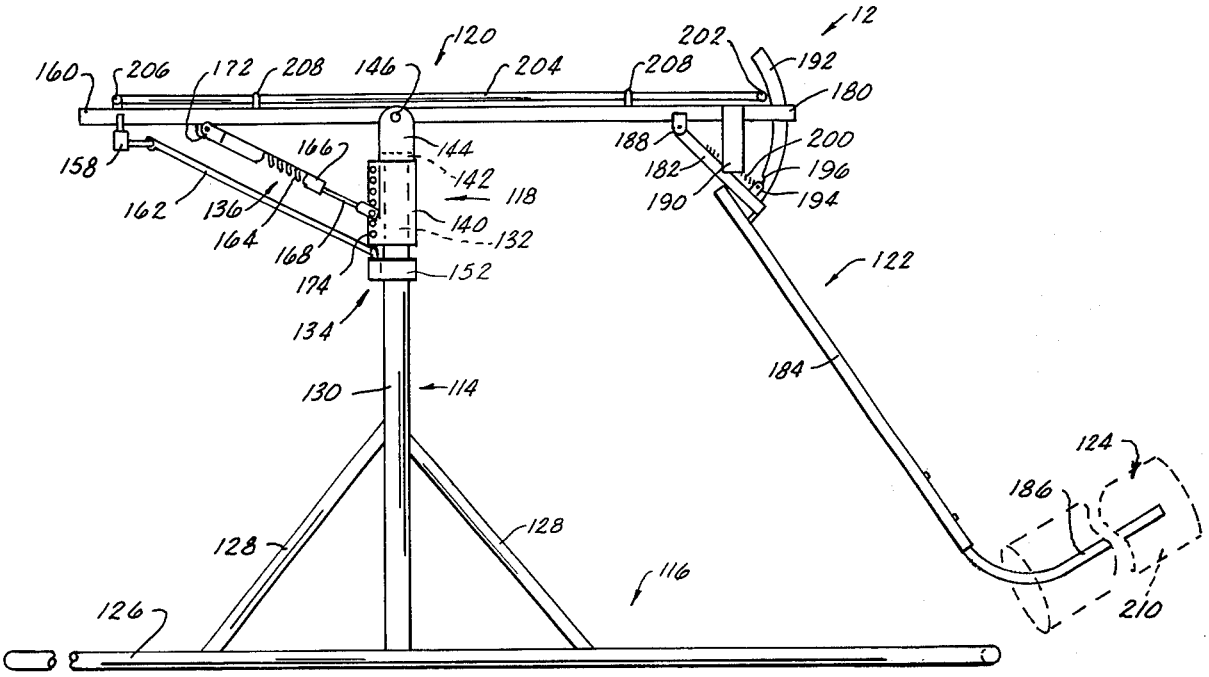
FIG. 8 is a side elevation view of an embodiment of the reaction machine with the dummy support arm in a lowered position, having the tackling dummy shown in dashed lines on the dummy support arm, and in the base and dummy support arm shortened for clarity.

Another embodiment, (2), of the reaction machine of this invention, is shown on Sheets 3 and 4 of the drawings and is generally indicated at 12. The reaction machine 12 includes an upright 114 supported on its lower end by a base 116 and having a hub 118 pivotally mounted on the upper end of the upright 114. A beam 120 is pivotally mounted with the hub 118 to pivot in a generally vertical direction and a dummy support arm 122 is swingably mounted with one end portion of the beam 120. A tackling dummy or the like is mounted on the end of the dummy support arm 122 as shown and as generally indicated at 124. The base 116 provides structural support for the upright 114 to hold it in a generally vertical position as shown. The base 116 is preferably a large, flat and annular structure which will enable the reaction machine 12 to be moved about on a football practice field or other supporting surface where the reaction machine 12 is to be used. More particularly, the base 116 is constructed similar to the base portion of the first described embodiment, (1), of the reaction machine of this invention, such having a generally annular outer member connected by cross braces and intermediate cross braces with the upright extending from the center portion thereof and having supporting braces. As shown in FIG. 8 the base 116 has an outer member 126 and upwardly extending braces 128 secured to the upright standard 130. Cross braces, intermediate cross braces and the juncture of the upright standard with the cross braces is not visible in FIG. 8, however, it is preferably constructed similar to the base of the first described embodiment, (1), of this invention, shown in FIG. 2. The upper surface of the base 116 is preferably constructed as a platform and covered by planks or a similar covering so a person can walk around on the base while operating the reaction machine 12. Since the reaction machine base 116 sits flush with the ground or other supporting surface, it can be easily pulled or pushed to a desired location on a football practice field for use or storage. It is to be noted that the base 116 can be constructed structurally different from the base structure shown in the drawings. For example, the base or support for the upright 114 can be permanently mounted in the ground or constructed to be mounted with a socket in the ground and removable therefrom.

Figure 11:
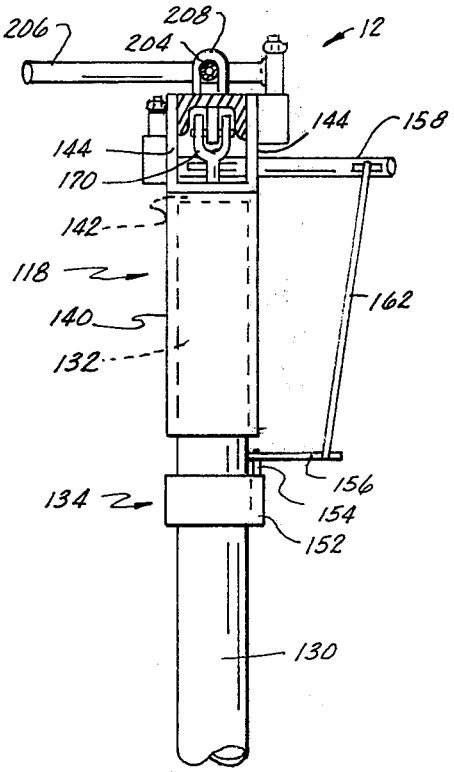
FIG. 11 is an elevation view of the upper portion of the reaction machine shown in FIG. 9 taken on line 11—11 in FIG. 9.

The hub 118 is rotatably mounted with the upper end portion 122 of the upright 114 and the beam 120 is pivotally mounted with the hub 118 so it can be rotated horizontally in full circle around the upright. The upper end portion of the upright standard 130 is indicated at 132 and is enclosed within the structure of the hub 118. A brake assembly generally indicated at 134 is mounted below the hub 118. A shock absorber assembly indicated generally at 136, is connected between the beam 120 and the hub 118 as shown to retard excessively rapid vertical pivoting movement of the beam 120 when the dummy support arm 122 and player end of the beam are raised rapidly. Preferably the hub 118 is a cap like structure having a cylindrical portion 140 extending over the upper exterior portion of the upright standard 130 with an end member or top 142 on the upper end thereof, contacting the upper end of the upright standard 130. Preferably the hub 118 is sized to be freely rotatable on the upright standard 130. A pair of upright and spaced members 144 extend upward from the hub top 142 for mounting the beam 120. The upright spaced members 144 are on opposite sides of the center portion of the hub 114 as shown in FIG. 11. The beam 120 is supported on a shaft, the end of which is indicated at 146. Preferably, the beam supporting shaft extends through the upright spaced members 144 and is generally positioned in line with the axis of rotation of the hub 118 on the upright 114. The beam 120 is preferably mounted at the mid portions thereof as shown.

The brake assembly 134 is a compressible band type brake assembly having the band thereof supported from the hub 118 and compressible to engage a portion of the upright standards below the hub 118. The brake assembly 134 is shown in detail in FIGS. 11, 12 and 13. A brake band fixed end support member 150 is secured to the hub outer portion 140 and extends downwardly therefrom, a brake band 152 is attached to support member 150 and extends substantially around the upright standard 130, a brake band free end support member 154 connects the brake band 152 with a brake band compressing lever 156. Preferably, the brake band 152 is constructed of a spring like resilient material which will move to an expanded position separating the interior of the brake band and the exterior of the upright standard when the brake compressing lever 156 is released. It is to be noted that the interior of the brake band 152 can be lined with a frictional brake lining material to increase the friction thereof on the upright standard. The compressing lever 156 is pivotally attached to both ends of the brake band 152. The brake band compressing lever 156 is pivotally mounted with the brake band fixed end support 150 and also pivotally attached to the brake band at the free end support 154, it moves in a pivoting motion about the fixed end support 150. Pivoting motion of the brake band compressing lever 156 moves the brake band 152 to bring the interior surface thereof in contact with the exterior surface of the upright standard 130. Control of the brake assembly 134 has a control lever 158 pivotally mounted with the beams operator end portion 160 which is connected by a link member 162 with the outer end of the brake compressing lever 156. The control link 162 joining the brake lever 158 and the compressible brake lever member 156 can be a cable or it can be a rod depending upon the desire of the user. When the brake lever 158 is pulled in the direction of the beams operator end 160 the brake compressing lever 156 is moved to pull the brake band 152 into contact with the upright standard 130. Releasing of the brake lever 156 will loosen the brake band 152 on the upright standard 130 and permit rotation of the hub 118 and the beam 120 about the upright 114.

Figure 12:
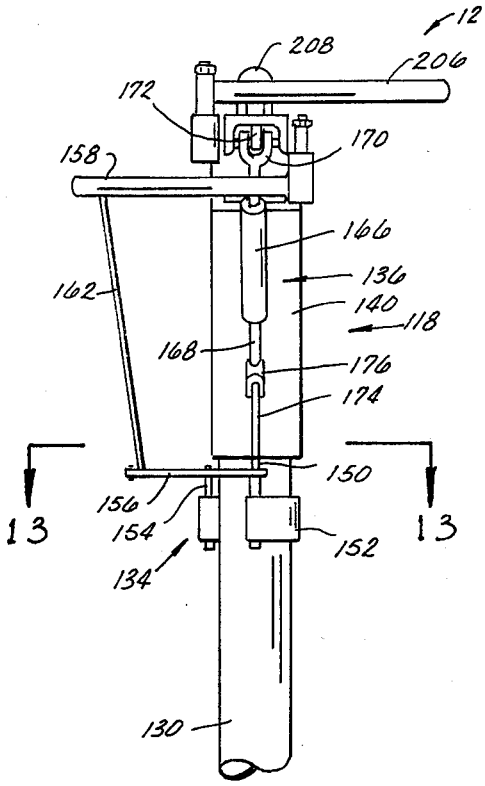
FIG. 12 is an end elevation view of the operator end portion of the upper portion of the reaction machine shown in FIG. 9.

The shock absorber assembly 36 is connected between the beams operator end portion 160 and the hub 118 and it functions to retard excessively rapid vertical pivoting motion of the beam 120 when the operator end portion 160 thereof is lowered. The shock absorber assembly 136 includes a spring 164 mounted in a container 166, the container being pivotally mounted with the beam 120, a plunger 168 extending from the container 166 which is connected with the spring and mounted on one end with the hub 118. The container 166 can be a tubular structure. The end of the container 166 which is attached to the beam 120 has a clevis 170 as shown in FIG. 12. The clevis 170 is attached with a beam mount 172 that extends downward from the underneath side of the beam 120. The spring 164 is compressible in the container 166 upon motion of the plunger 168. The plunger 168 is attached to a perforated member 174 on the hub 118. The perforated member 174 is an elongated member secured with a side of the hub outer member 140 and extending therealong as shown with a plurality of apertures therethrough. The shock absorber plunger 168 has a clevis 176 attachable to any of the apertures in the perforated member 174. The brake assembly support member 150 preferably extends downward from the perforated member 174. Due to the clevis attachment of the shock absorber assembly 136 with the beam and the hub 118 it will pivot accordingly between the beam 120 and the hub 118 as the beam 120 is pivoted at its support with the hub in the vertical direction. As the beams operator end portion 160 is lower than the spring 164 is compressed in the container 166 by the plunger 168. Compression of the spring 164 provides resistance to the pivotal motion of the beam 120 in lowering its operator end portion 160. The amount of compression of the spring can be varied by positioning the plunger end clevis 176 in the different apertures of the support member 174 which changes the length in which it operates. This adjustment can also be used to change the height of the beams player end portion. The amount of resistance of the shock absorber assembly 136 is adjustable and is adjusted by positioning of the clevis 176 in the different apertures of the perforated support member 174. Adjusting the retarding force of the shock absorber assembly 136 provides a control over the rate at which the beams operator end portion 160 can be lowered, thus providing a control over its vertical pivoting speed. Controlling the downward movement of the beams operator end portion 160 by the shock absorber assembly 136 has two advantages; one, it lessens the shock of the impact forces on the machine which could damage it, and; two, it makes the machine safer for a person to operate. The operator end portion 160 of the beam 120 can be moved very rapidly downward when the tackling dummy 124 is rapidly raised from a ground position to the raised position and the beam 120 is in turn rapidly pivotally moved due to upward motion of the dummy support arm 122 and its contacting the beam 120 in the raised position.

When the reaction machine 12 is being used for tackling or blocking practice the dummy support arm 122 is in the lowered position when the dummy 124 is on the ground, similar to the position shown in FIG. 8. In this position the brake assembly 134 is set and the beams operator end portion 160 is raised slightly from that shown in FIG. 8. As a player rushes the tackling dummy 123 and hits the dummy 123 the dummy support arm 122 is raised rapidly by the player to the raised position relative to the beam 120. When the dummy support arm 122 is raised rapidly to the raised position it contacts or hits the beam and the beam 120 is pivoted on its supporting shaft. The shock absorber assembly 136 retards the rapid vertical downward movement of the beams operator end portion 160 by the spring 164 absorbing some of the energy of the players impact which caused the beam 120 to be pivoted. It is to be noted that the spring 164 in the shock absorber assembly 136 can be replaced by other resilient members; for example a rubber or rubber-like resilient member, or a fluid.

Figure 10:
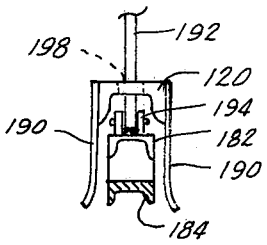
FIG. 10 is an elevation view of the outer end of the beam of the reaction machine shown in FIG. 9 taken on line 10—10 in FIG. 9.
Figure 13:
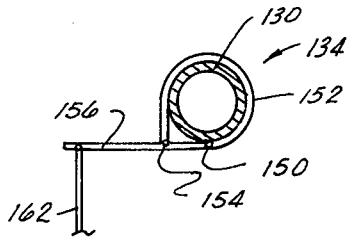
FIG. 13 is an elevation view of the brake portion of the reaction machine shown in FIG. 9, the view taken on line 13—13 of FIG. 12.

The dummy support arm 122 is pivotally mounted with the beams player end portion 180. The dummy support arm has an upper arm portion 182, a lower arm portion 184 and a flexible arm portion 186 on its outer end. The upper arm portion 182 is pivotally or swingably supported on one end portion thereof by a mount 188 on the lower side of the beam 120. The unmounted end of the upper arm portion 182 is secured to the lower arm portion 184. A pair of guide members 190 are secured to the beams player end portion 180 and extend downwardly therefrom has shown on opposite sides of the beam 120 forming a guide for the upper arm portion 182. FIG. 10 shows the position of the guide members 190 in relation to the dummy support arm 122. The guides 190 are positioned in a spaced relation on opposite sides of the upper arm portion 182 so it will move therebetween. The guides 190 prevent lateral bending or twisting movement of the upper arm portion 182 relative to the beam 120. Lateral movement of the upper arm portion 182 can be caused by excessive shock forces or lateral forces imposed on the dummy support arm 122 as it is moved to the raised position when it is hit by a football player. A latch member is pivotally mounted with the upper arm portion 182 and is used for securing the dummy support arm 122 in the raised position relative to the beam 120. The latch member 180 is attached by a pivotal mount 194 on its lower end portion with the outer end portion of the upper arm portion 182 and it has a notch 196 spaced above its pivotal attachment the notch 196 being engagable in a slot 198 in the beams player end portion 180. The latch member 192 is preferably curved and passes through the slot 198 in the beam and the notch 196 is engagable over an inner edge portion of the notch when the dummy support arm 122 is in the raised position. The slot 198 is shown in FIG. 10. A spring 200 is connected between an inner end portion of the upper arm portion 182 and the lower portion of the curved latch member 192 to resiliently urge the latch member 192 in the general direction of the center portion of the beam 120 for engaging the notch 196 in the edge of the slot 198. A movable wedge or block member 202 is positioned on top of the beam 120 and is used to push the latch member 192 into the center portion of the slot 198 releasing the notch 196 from the edge of the slot for dropping or lowering the dummy support arm 122. The wedge or block member 202 is connected to a control rod 204 which is pivotally connected with a control lever 206. The control rod 204 is held in position by guide members 208 on top of the beam 120. Moving the control lever 206 moves the block or wedge 202 and along the beam 120. When the wedge or block 202 is pushed against the latch member 198 to move it the notch 196 is disengaged from the edge of the slot 198 so the dummy support arm 122 will fall into the lowered position by the force of gravity.

The upturned flexible arm portion 186 of the dummy support arm 122 is preferably a leaf spring member on which the tackling dummy 124 is attached. An elongated cylindrical type of dummy is specifically indicated at 210. In general, the tackling dummy can be constructed in any number of shapes and it is preferably a generously padded and generally annular object in an elongated form to slip over and cover the flexible arm portion 186. Preferably, the tackling dummy 124 is sufficiently long enough to extend upward approximately to the waist of a player so when the tackling dummy 124 is in the lowered position it can be used for both blocking and tackling practices.

Figure 9:
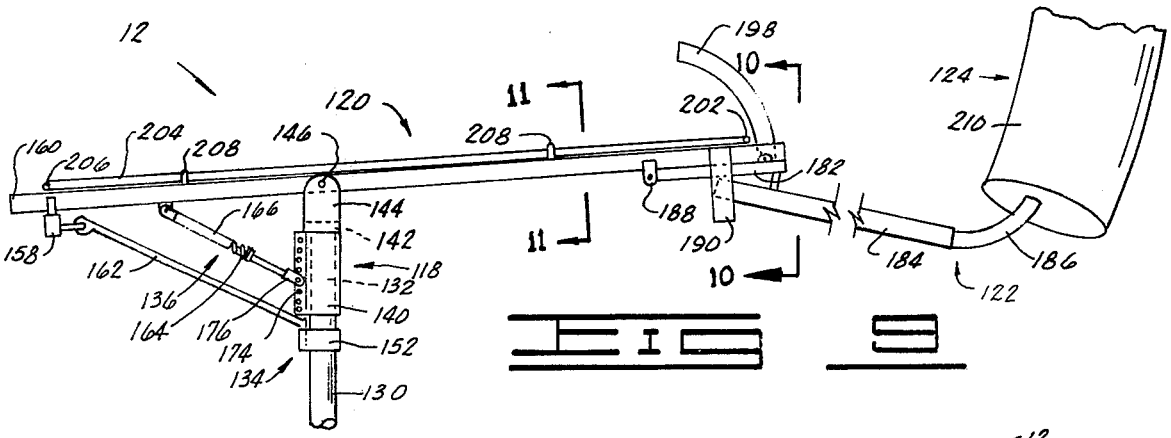
FIG. 9 is a side elevation view of the upper portion of the reaction machine shown in FIG. 8 with the dummy support arm in the raised position and shown shortened for clarity and having only a portion of the dummy shown.

In the use and operation of the reaction machine 12 of this embodiment, (2), of this invention, such provides a machine which is particularly adapted for use in football player blocking and tackling practice. The machine 12 has a padded tackling dummy 124 movable between a lowered position on the ground and in a raised position above the ground. The reaction machine 12 is shown in the lowered position in FIG. 8 and it is shown in the raised position in FIG. 9. The preferred use of the reaction machine 12 is to place it on a football practice field with the dummy support arm 122 in the raised position generally as illustrated in FIG. 9, and as the coach or operator moves it horizontally in pivoting motion about the upright the player mirrors or follows movement of the dummy. At any given time the coach or operator can drop the dummy 124 and proper reaction by the player results in the dummy 124 being hit by the player before it reaches the ground driven or raised back to the raised position relative to the beam 120. The dummy 124 can be hit with the head, shoulders or arms in offensive or defensive drills. The wedge or block control lever 206 is pushed to drop the dummy 124. The brake assembly 136 should be engaged as a player rushes the reaction machine 12 when the tackling dummy 124 is dropped to ensure that the beam 120 stays in a fixed horizontal position. If the player rushes the tackling dummy 124 from a position which is not directly in line with the upright 114 and the tackling dummy 124 then the beam 120 will be rotated horizontally about the upright 114. Once the dummy support arm 122 and the beam 120 are raised the brake assembly 136 can be released. It is to be noted that the rotatable motion of the beam 120 in the horizontal direction allows two or more groups of football players to utilize the reaction machine 12 at the same time as the groups can be positioned on opposite sides of the reaction machine and the players moving alternately from the separate groups one at a time can rush the tackling dummy 124 in rapid succession as it is positioned first in the direction of one group and next positioned in the direction of the other group. Additionally, it is to be noted that the reaction machine can be used by placing the tackling dummy 124 in a lowered position at or near ground level so that a player can rush it, hitting it and raising it to the raised position. A person operating the reaction machine 12 can walk around the upright 114 while standing on the base 116 and his weight in addition to the weight of the reaction machine structure will hold same in position on the football practice field or other supporting surface.

As will become apparent from the foregoing description of the applicant's reaction machine structure, relatively inexpensive and structurally simple means have been provided to aid in the training of football players, particularly in the practice of blocking and tackling maneuvers. The structure is simple to use and simple in construction. Additionally, the reaction machine can be utilized by one or more groups of football players at the same time, thus making for a more efficient use of it as a training aid.

In the manufacture of the reaction machine structure of this invention, it is obvious that the structure can be easily constructed to achieve the end product. The structure of the reaction machine is relatively simple and can be constructed with sufficient strength to have a prolonged use without sustaining damage by player impact. The reaction machine is constructed to mount a tackling dummy which can be removed from the structure if desired.

While the invention has been described in conjunction with preferred specific embodiments thereof, it will be understood that this description is intended to illustrate and not to limit the scope of the invention, which is defined by the following claims.

I claim:

1. A football reaction practice machine, comprising:

a. a base, b. an upright post member mounted on its lower end to said base, c. an elongated beam mounted intermediate its ends on the upper end of said upright member for rotational movement in a generally horizontal plane and for pivotal movement in a generally vertical plane, d. an elongated dummy support arm having one of its ends pivotally mounted on one end of said beam for movement therewith and for movement in a generally vertical plane, said dummy support arm having an elongated upturned outer end portion, said upturned outer end portion having a padded tackling dummy mounted thereon, e. first means on said elongated beam and second means mounted on said dummy support arm; said first and second means cooperatively engaging to hold said dummy support arm in a raised position, third means mounted on said beam for disengaging said first and second means to release said support arm for movement to a lowered position, said third means being an elongated rod member movable along said beam, said second means being a latch member and said first means being an edge portion of said one end of said elongated beam, f. means for urging said second means into engagement with said first means, and g. means at the other end of said elongated beam operable to move said rod into engagement with said second means to disengage said second means from said first means to permit said dummy support arm to move to said lowered position under its own weight.

2. The machine of claim 1, wherein:

a. a hub is rotatably mounted on said upper end of said upright post member and said beam is pivotally attached to said hub, b. brake means operatively mounted on said hub for engagement with means on said upright post member to hold said beam in a fixed generally horizontal position, and c. shock absorber means mounted between said hub and said beam to retard rapid vertical pivoting movement of said beam.

3. The machine of claim 2, wherein:

a. said beam is attached to said hub at approximately the midpoint of said beam and the ends of said beam extends a substantial distance from said upright post member.

b. said brake means has a shoe element operable to engage said means an said upright post member to maintain said beam in said fixed position, and c. said shock absorber means has an elongated rod having one of its ends pivotally attached to said beam at a point opposite said dummy support arm and at a substantial distance from said hub said rod also being slidably attached to a guide member secured to said hub, and a compressible resilient member mounted on said elongated rod intermediate the ends of said rod compressible upon movement of said beam when said end thereof opposite said dummy support arm is lowered.

4. The machine of claim 3, wherein:

a. said base is a platform on which a person can stand, b. said brake means has an operating handle at said other end of said elongated beam for manipulation by a person standing on said platform to engage and disengage said shoe with said means on said upright post member, and c. a spindle is rotatably mounted on the upper end of said upright post member and said hub is mounted on said spindle.

5. The machine of claim 1, wherein:

a. said latch member has a notch engageable with said beam when said dummy support arm is in raised position, and b. said means for urging said latch member into engagement with said beam is a spring acting in tension.

* * * * *